US009992602B1

(12) United States Patent
Allen

(10) Patent No.: US 9,992,602 B1
(45) Date of Patent: Jun. 5, 2018

(54) DECOUPLED BINAURAL RENDERING

(71) Applicant: Google Inc., Mountain View, CA (US)

(72) Inventor: Andrew Allen, San Jose, CA (US)

(73) Assignee: GOOGLE LLC, Mountain View, CA (US)

( * ) Notice: Subject to any disclaimer, the term of this patent is extended or adjusted under 35 U.S.C. 154(b) by 0 days. days.

(21) Appl. No.: 15/404,379

(22) Filed: Jan. 12, 2017

(51) Int. Cl.
*H04S 7/00* (2006.01)
*H04S 3/00* (2006.01)

(52) U.S. Cl.
CPC ..... *H04S 7/303* (2013.01); *H04S 3/008* (2013.01); *H04S 7/307* (2013.01); *H04S 2400/11* (2013.01); *H04S 2400/13* (2013.01); *H04S 2420/01* (2013.01); *H04S 2420/11* (2013.01)

(58) Field of Classification Search
CPC ..... H04S 7/303; H04S 7/304; H04S 3/008; H04S 7/307; H04S 2400/11; H04S 2400/13; H04S 2420/01; H04S 2420/11
See application file for complete search history.

(56) References Cited

U.S. PATENT DOCUMENTS 6,766,028 B1 * 7/2004 Dickens ..... H04S 3/004 381/17
8,705,750 B2 * 4/2014 Berge ..... H04R 3/12 381/103
9,101,299 B2 8/2015 Anderson
9,215,544 B2 12/2015 Faure et al.
9,332,360 B2 5/2016 Edwards
9,420,393 B2 8/2016 Morrell et al.
9,584,934 B2 2/2017 Kim et al.
2009/0116657 A1 5/2009 Edwards et al.
2009/0208022 A1 8/2009 Fukui et al.
2010/0080396 A1 4/2010 Aoyagi et al.
2013/0064375 A1 3/2013 Atkins et al.
2014/0355794 A1 12/2014 Morrell et al.
2016/0219388 A1 7/2016 Oh et al.
2016/0241980 A1 * 8/2016 Najaf-Zadeh ..... H04S 7/303
(Continued)

FOREIGN PATENT DOCUMENTS

WO 2012/168765 A1 12/2012

OTHER PUBLICATIONS

"Definition of Transitive", Merriam-Webster Dictionary, printed Sep. 26, 2017, 1 page.
(Continued)

*Primary Examiner* — Brenda C Bernardi
(74) *Attorney, Agent, or Firm* — Brake Hughes Bellermann LLP

(57) ABSTRACT

Techniques of performing binaural rendering involve generating separate locations of virtual sources on the sphere for each ear of a listener. Along these lines, consider a set of actual audio sources that are not equidistant from a central point. To provide a listener with ambisonic audio, a sphere is defined with the listener at its center. When a source is not on the surface of the sphere, respective rays from the source to each of the listener's ears may not intersect the sphere at the same point. Rather, to provide a more accurate representation of the actual source, virtual loudspeakers are placed at each of the sphere intersections, a first virtual loudspeaker propagating audio to the left ear, a second virtual loudspeaker propagating audio to the right ear.

18 Claims, 4 Drawing Sheets

(56) References Cited

U.S. PATENT DOCUMENTS

2017/0245082 A1* 8/2017 Boland ..... H04S 1/005

OTHER PUBLICATIONS

"Definition of Transitory", Merriam-Webster Dictionary, printed Sep. 26, 2017, 1 page.
Politis, et al., "JSAmbisonics: A Web Audio library for interactive spatial sound processing on the web", ReaserchGate, Ambisonics Processing on the Web, Sep. 23, 2016, 9 pages.
Rafaely, "Fundamentals of Spherical Array Processing", Spring Topics in Signal Processing, vol. 8, Chapter 1, 2015, 39 pages.
International Search Report and Written Opinion for International Application No. PCT/US2017/067617, dated Mar. 19, 2018, 10 pages.

* cited by examiner

DECOUPLED BINAURAL RENDERING

TECHNICAL FIELD

This description relates to binaural rendering of sound fields in virtual reality (VR) and similar environments.

BACKGROUND

Ambisonics is a full-sphere surround sound technique: in addition to the horizontal plane, it covers sound sources above and below the listener. Unlike other multichannel surround formats, its transmission channels do not carry speaker signals. Instead, they contain a speaker-independent representation of a sound field called B-format, which is then decoded to the listener's speaker setup. This extra step allows the producer to think in terms of source directions rather than loudspeaker positions, and offers the listener a considerable degree of flexibility as to the layout and number of speakers used for playback. In ambisonics, an array of virtual loudspeakers surrounding a listener generates a sound field by decoding a sound file encoded in a scheme known as B-format from a sound source that is isotropically recorded. The sound field generated at the array of virtual loudspeakers can reproduce the effect of the sound source from any vantage point relative to the listener. Such decoding can be used in the delivery of audio through headphone speakers in Virtual Reality (VR) systems. Binaurally rendered ambisonics refers to the creation of virtual loudspeakers which combine to provide a pair of signals to left and right headphone speakers. Frequently, such rendering takes into account the effect of a human auditory system using a set of Head Related Transfer Functions (HRTFs). Performing convolutions on signals from each loudspeaker with the set of HRFTs provides the listener with a faithful reproduction of the sound source.

Conventional approaches to performing binaural rendering involve panning a set of loudspeakers arranged on a sphere with a listener at the center. Each loudspeaker is defined as an effective source at a specified point on the sphere. Each such point has a left and right HRTF from which the sound field in each ear may be binaurally rendered.

SUMMARY

In one general aspect, a method can include receiving, by processing circuitry of an audio rendering computer configured to render sound fields in a left ear and a right ear of a listener, a sound wave produced by an actual audio source located at an actual audio position in space with respect to a listener. The method can also include generating a plurality of virtual audio locations, each of the plurality of virtual audio locations being at a respective elevation angle and azimuthal angle on the surface of a sphere having a center at which the listener is located, the respective elevation angle and azimuthal angle at which each of the plurality of virtual audio locations being based on the actual audio position in space at which the actual audio source is located with respect to the listener. The method can further include respectively producing a first sound field and a second sound field from virtual loudspeakers at a first virtual location and a second virtual location of the plurality of virtual audio locations. The method can further include performing a first convolution operation on the first sound field and a left head-related transfer function (HRTF) associated with the first virtual location to render a left sound field in the left ear of the listener and performing a second convolution operation on the second sound field and a right HRTF associated with the second virtual location to render a right sound field in the right ear of the listener.

The details of one or more implementations are set forth in the accompanying drawings and the description below. Other features will be apparent from the description and drawings, and from the claims.

DETAILED DESCRIPTION

Some audio sources are not equidistant from the listener. For example, in VR one may wish to simulate the effects of a mosquito flying near the listener. The conventional approaches do not produce accurate representations of a non-equidistant audio source because the distance between the effective source on the sphere and each ear of the listener differs significantly from the radius of the sphere. Accordingly, the HRTFs from the effective source may not accurately reproduce the original audio source. In this case, one may need to resort to using many distance-dependent HRTFs to achieve the desired accuracy in audio reproduction. Such distance-dependent HRTFs may require an excessive amount of computational resources.

In accordance with the implementations described herein and in contrast with the above-described conventional approaches to performing binaural rendering, improved techniques involve generating separate locations of virtual sources on the sphere for each ear of the listener. Along these lines, consider a set of actual audio sources that are not equidistant from a central point (e.g., a fly buzzing near a listener's head). To provide a listener with ambisonic audio, an audio processor defines a sphere in space with the listener at its center. When an audio source encoded in an ambisonic audio format (e.g., B-format) has a position on the surface of the sphere, then decoded ambisonic sound may be generated from a virtual loudspeaker at the position of the audio source on the sphere. The ambisonic audio may be modeled as propagating along respective rays to each of the listener's left and right ears. However, when a source is not on the surface of the sphere, the respective rays from the source to each of the listener's ears may not intersect the sphere at the same point. Rather, to provide a more accurate representation of the actual source, virtual loudspeakers are placed at each of the sphere intersections, a first virtual loudspeaker propagating audio to the left ear, a second virtual loudspeaker propagating audio to the right ear. Advantageously, the improved techniques provide a more accurate representation of actual audio sources with ambisonic audio at a minimal cost in computational resources.

Figure 1:
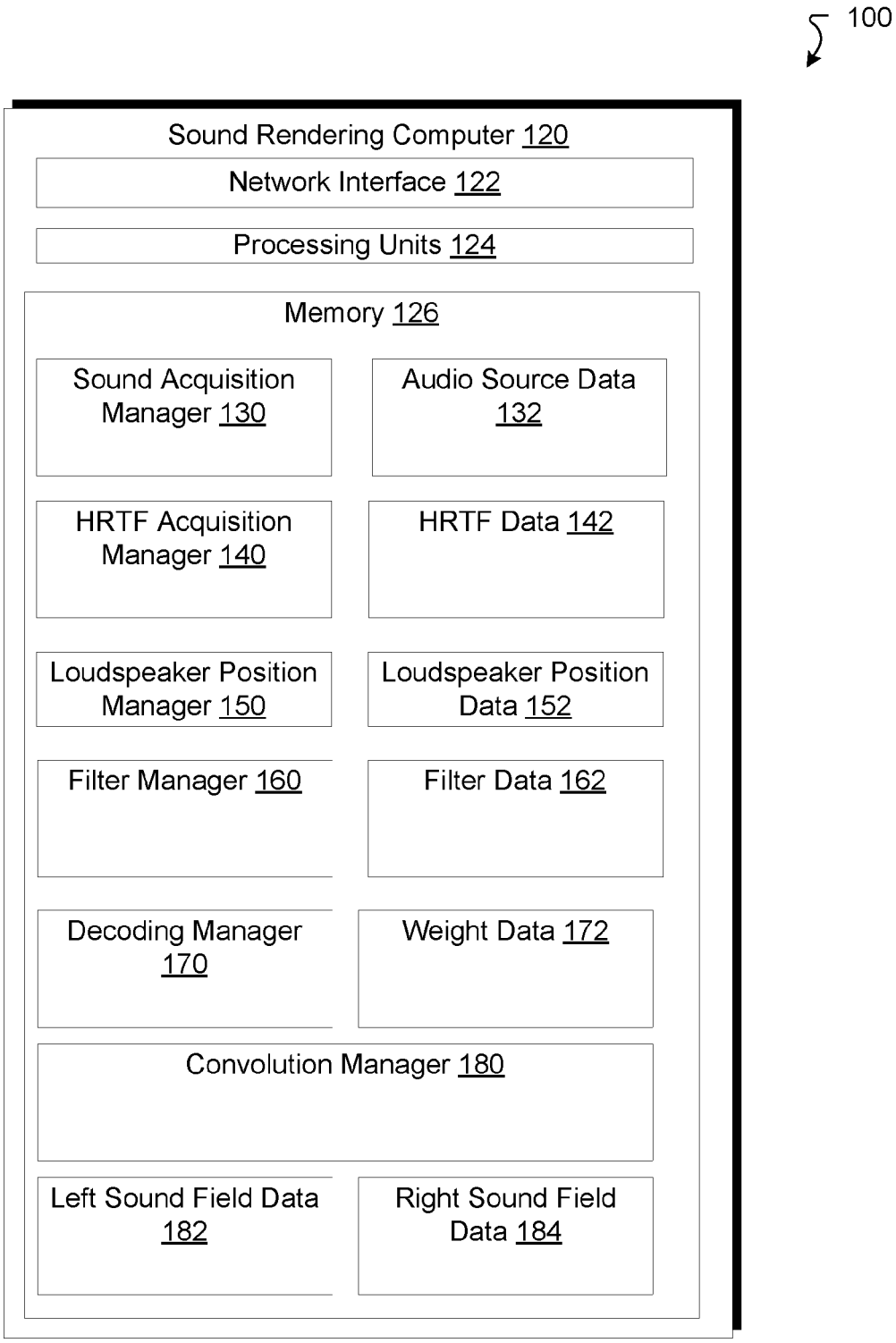
FIG. 1 is a diagram that illustrates an example electronic environment for implementing improved techniques described herein.

FIG. 1 is a diagram that illustrates an example electronic environment 100 in which the above-described improved techniques may be implemented. As shown, in FIG. 1, the example electronic environment 100 includes a sound rendering computer 120.

The sound rendering computer 120 is configured to binaurally render ambisonic audio representing near- and far-field actual audio sources in each ear of a listener. The sound rendering computer 120 includes a network interface 122, one or more processing units 124, and memory 126. The network interface 122 includes, for example, Ethernet adaptors, Token Ring adaptors, and the like, for converting electronic and/or optical signals received from the network 170 to electronic form for use by the point cloud compression computer 120. The set of processing units 124 include one or more processing chips and/or assemblies. The memory 126 includes both volatile memory (e.g., RAM) and non-volatile memory, such as one or more ROMs, disk drives, solid state drives, and the like. The set of processing units 124 and the memory 126 together form control circuitry, which is configured and arranged to carry out various methods and functions as described herein.

In some embodiments, one or more of the components of the sound rendering computer 120 can be, or can include processors (e.g., processing units 124) configured to process instructions stored in the memory 126. Examples of such instructions as depicted in FIG. 1 include a sound acquisition manager 130, a HRTF acquisition manager 140, a loudspeaker position manager 150, a filter manager 160, a decoding manager 170, and a convolution manager 180. Further, as illustrated in FIG. 1, the memory 126 is configured to store various data, which is described with respect to the respective managers that use such data.

The sound acquisition manager 130 is configured to acquire sound data 132 from various sources. For example, the sound acquisition manager 130 may the sound data 132 from an optical drive or over the network interface 122. Once it acquires the sound data 132, the sound acquisition manager is also configured to store the sound data 132 in memory 126. In some implementations, the sound acquisition manager 130 streams the sound data 132 over the network interface 122.

The sound data 132 includes position data for each actual source. In this case, the position data for an actual source may take the form of a triplet $(r, \theta, \varphi)$, where r is the distance between the actual source and the center of the sphere, $\theta$ is an elevation angle, and $\varphi$ is an azimuth angle.

In some implementations, the sound acquisition manager 130 is configured to produce a retarded-in-time sound wave from each of the loudspeakers based on a distance of an actual source from each of the left ear and the right ear. In such cases, each retarded-in-time sound wave may be attenuated by an amount based on the distance of the actual source from each of the left ear and the right ear.

In some implementations, the sound data 132 is encoded in B-format, or first-order ambisonics with four components, or ambisonic channels. In other implementations, the sound data 132 is encoded in higher-order ambisonics, e.g., to order N. In this case, there will be $(N+1)^2$ ambisonic channels.

The loudspeaker position manager 150 is configured to produce, for each actual audio source, loudspeaker position data 152 indicating left and right virtual loudspeakers on the sphere respectively producing sound for the left and right ear of the listener from that actual audio source. Further details of how the loudspeaker position manager 150 produces the loudspeaker position data 152 is discussed in detail with respect to FIG. 2.

The HRTF acquisition manager 140 is configured to acquire a single left or right HRTF from each left or right virtual loudspeaker positioned about the listener according to the loudspeaker position data 152. For example, at some earlier time, the HRTF may measure left or right HRTF data 142 for each corresponding left or right loudspeaker for a given listener. In some implementations, the HRTF acquisition manager 140 measures a left or right head-related impulse responses (HRIRs) from a given position on the sphere over time and derives the left and right HRFT data 142 from the left and right HRIRs through Fourier transformation.

In some implementations, the filter manager 160 is configured to generate filter data 162 representing a bandpass filter. The filter manager 162 is also configured to apply the bandpass filter represented by the filter data 162 to the audio produced by each virtual loudspeaker. For example, in some arrangements it may be desired to boost the bass frequencies of the audio produced by a virtual loudspeaker corresponding to a left ear of the listener when the actual source is close to the left ear of the listener. In this case, the filter manager may generate a low-pass filter that, as the filter data 162, includes a set of normalized amplitude values across various sampled frequencies.

The decoding manager 170 is configured to decode the sound data 132 acquired by the sound acquisition manager 130 to produce, as weight data 162, weights for each ambisonic channel at each loudspeaker. Each weight at each loudspeaker represents an amount of a spherical harmonic corresponding to that ambisonic channel emitted by that loudspeaker. The weights may be determined from the sound data 132 and the loudspeaker position data 152.

The convolution manager 180 is configured to perform convolutions on the weight data 162 with the HRTF data 142 to produce sound fields in both left and right ears of the listener, i.e., left sound field data 182 and right sound field data 184.

In some implementations, the memory 126 can be any type of memory such as a random-access memory, a disk drive memory, flash memory, and/or so forth. In some implementations, the memory 126 can be implemented as more than one memory component (e.g., more than one RAM component or disk drive memory) associated with the components of the sound rendering computer 120. In some implementations, the memory 126 can be a database memory. In some implementations, the memory 126 can be, or can include, a non-local memory. For example, the memory 126 can be, or can include, a memory shared by multiple devices (not shown). In some implementations, the memory 126 can be associated with a server device (not shown) within a network and configured to serve the components of the sound rendering computer 120.

The components (e.g., modules, processing units 124) of the sound rendering computer 120 can be configured to operate based on one or more platforms (e.g., one or more similar or different platforms) that can include one or more types of hardware, software, firmware, operating systems, runtime libraries, and/or so forth. In some implementations, the components of the sound rendering computer 120 can be configured to operate within a cluster of devices (e.g., a server farm). In such an implementation, the functionality and processing of the components of the sound rendering computer 120 can be distributed to several devices of the cluster of devices.

The components of the sound rendering computer 120 can be, or can include, any type of hardware and/or software configured to process attributes. In some implementations, one or more portions of the components shown in the components of the sound rendering computer 120 in FIG. 1 can be, or can include, a hardware-based module (e.g., a digital signal processor (DSP), a field programmable gate array (FPGA), a memory), a firmware module, and/or a software-based module (e.g., a module of computer code, a set of computer-readable instructions that can be executed at a computer). For example, in some implementations, one or more portions of the components of the sound rendering computer 120 can be, or can include, a software module configured for execution by at least one processor (not shown). In some implementations, the functionality of the components can be included in different modules and/or different components than those shown in FIG. 1.

Although not shown, in some implementations, the components of the sound rendering computer 120 (or portions thereof) can be configured to operate within, for example, a data center (e.g., a cloud computing environment), a computer system, one or more server/host devices, and/or so forth. In some implementations, the components of the sound rendering computer 120 (or portions thereof) can be configured to operate within a network. Thus, the components of the sound rendering computer 120 (or portions thereof) can be configured to function within various types of network environments that can include one or more devices and/or one or more server devices. For example, the network can be, or can include, a local area network (LAN), a wide area network (WAN), and/or so forth. The network can be, or can include, a wireless network and/or wireless network implemented using, for example, gateway devices, bridges, switches, and/or so forth. The network can include one or more segments and/or can have portions based on various protocols such as Internet Protocol (IP) and/or a proprietary protocol. The network can include at least a portion of the Internet.

In some embodiments, one or more of the components of the sound rendering computer 120 can be, or can include, processors configured to process instructions stored in a memory. For example, the sound acquisition manager 130 (and/or a portion thereof), the HRTF acquisition manager 140 (and/or a portion thereof), the loudspeaker position manager 150 (and/or a portion thereof), the filter manager 160, the decoding manager 170 (and/or a portion thereof), and the convolution manager 180 (and/or a portion thereof) can be a combination of a processor and a memory configured to execute instructions related to a process to implement one or more functions.

Figure 2:
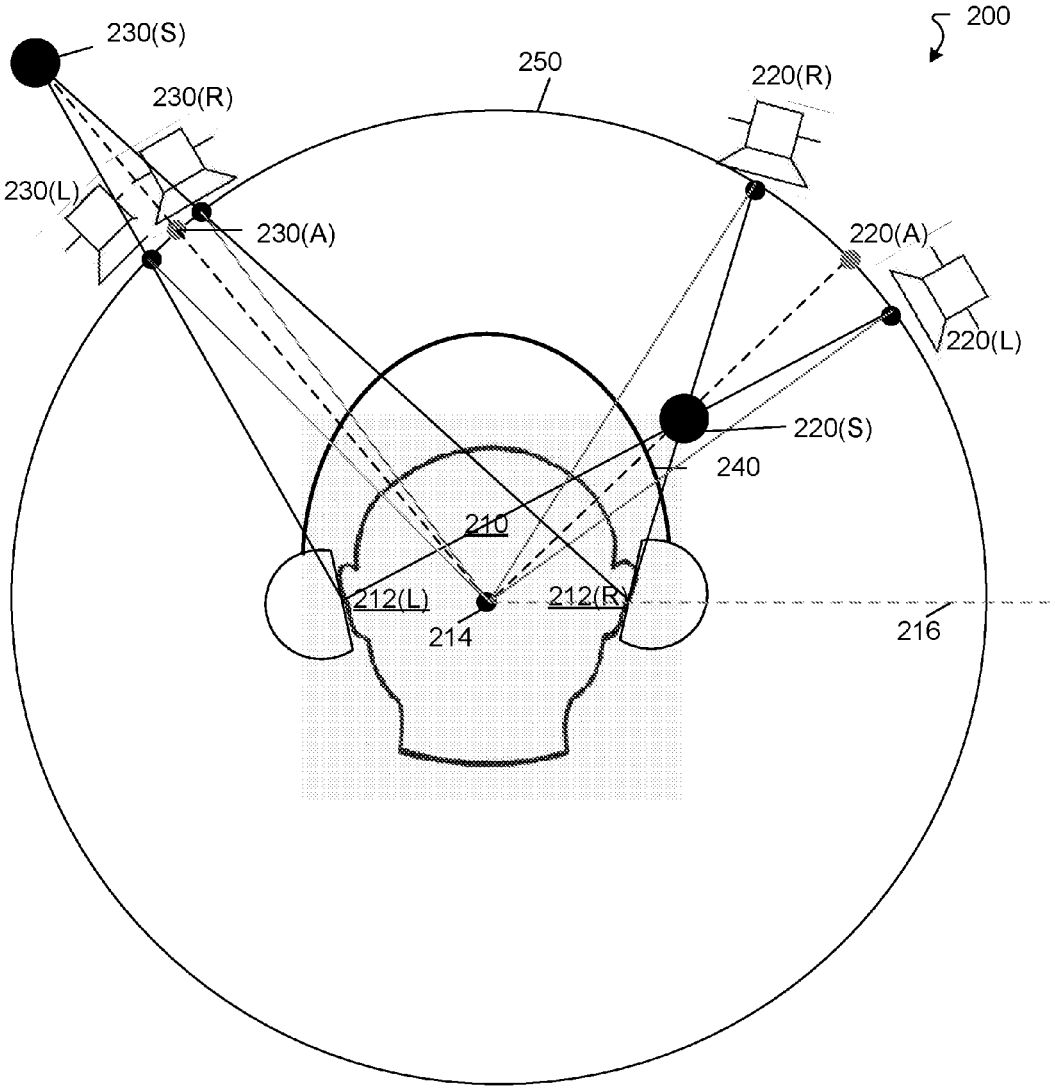
FIG. 2 is a diagram that illustrates an example sound field geometry according to the improved techniques described herein.

FIG. 2 illustrates an example sound field environment 200 according to the improved techniques. Within this environment 200, there is a listener whose head 210 has a left ear 212(L), a right ear 212(R), a forward axis 214 (out of the paper), and a positive side axis 216. The listener is wearing a pair of headphones 240.

As illustrated in FIG. 2, the listener 210 (more precisely, the origin at the intersection of the forward axis 214 and the side axis 216) is at the center of a sphere 250. The sphere has, in some implementations, a radius equal to an impulse response (IR) capture radius, i.e., a distance at which sounds are expected to be recorded and produced. In FIG. 2, there is an actual audio source 220(S) inside the sphere 250 and an actual audio source 230(S) outside the sphere 250.

If the actual audio sources 220(S) and 230(S) were equidistant from the source, then they would be respectively positioned on the sphere 250 at the points 220(A) and 230(A). In that case, there would be a left and right HRTF from each virtual loudspeaker placed at the points 220(A) and 230(A).

Nevertheless, the actual audio sources 220(S) and 230(S) are not equidistant from the origin. In this case, the loudspeaker position manager 150 (FIG. 1) determines a left virtual loudspeaker position 220(L) and a right virtual loudspeaker position 220(R) given the location of the actual source 220(S) as specified in the sound data 132. Similarly, the loudspeaker position manager 150 determines a left virtual loudspeaker position 230(L) and a right virtual loudspeaker position 230(R) given the location of the actual source 230(S) as specified in the sound data 132.

In some implementations and as illustrated in FIG. 2, the loudspeaker manager 150 determines the left virtual loudspeaker position 220(L) by locating the intersection of the line between the listener's left ear 212(L) and the actual audio source 220(S) with the sphere 250. Similarly, the loudspeaker manager 150 determines the right virtual loudspeaker position 220(R) by locating the intersection of the line between the listener's right ear 212(R) and the actual audio source 220(S) with the sphere 250. The loudspeaker manager 150 performs similar operations to determine the left virtual loudspeaker position 230(L) and the right virtual loudspeaker position 230(R) from the position of the actual audio source 230(A).

To calculate the sound fields in each ear 212(L) and 212(R), consider the loudspeakers 220(A,B) as being arranged equidistant from the listener on the surface of the sphere 250. The frequency-space sound fields $X_L$, $X_R$ emanating respectively from the loudspeakers 220(L,R) is given as an expansion in spherical harmonics:

$$X_L(\theta_L, \phi_L, f) = \sum_{l=0}^{N} \sum_{m=-l}^{l} w_{l^2+l+m}(f) Y_{lm}(\theta_L, \phi_L), \tag{1}$$

$$X_R(\theta_R, \phi_R, f) = \sum_{l=0}^{N} \sum_{m=-l}^{l} w_{l^2+l+m}(f) Y_{lm}(\theta_R, \phi_R). \tag{2}$$

Note that $Y_{lm}(\theta,\varphi)$ represents the (l,m) real spherical harmonic as a function of elevation angle θ and azimuthal angle φ. The totality of the real spherical harmonics form an orthonormal basis set over the unit sphere. However, truncated representations over a finite number, $(N+1)^2$, of ambisonic channels are considered herein. Also, the weights $w_k(f)$ are functions of frequency f and represent the weight data 172. The weights $w_k(f)$, in the absence of additional filtering, are the same for the left and right virtual loudspeakers 220(L,R). In some implementations, the sound acquisition manager 130 (FIG. 1) acquires time-dependent weights and performs a Fourier transformation on, e.g., 1-second blocks of the weights to provide the frequency-space weights above.

It should be appreciated that the weights $w_k$ (f) are indexed in order according to the relation $k=l^2+l+m$. Conversely, a spherical harmonic order (l,m) may be determined from an ambisonic channel k according to $l=\lfloor\sqrt{k}\rfloor$, $m=k-l(l+1)$. These relations provide a unique, one-to-one mapping between a spherical harmonic order (l,m) and an ambisonic channel k.

Note that the angular positions $(\theta_L,\varphi_L)$ and $(\theta_R,\varphi_R)$ of the virtual loudspeakers 220(L) and 220(R) on the sphere 250 may each be determined from the angular position of the actual audio source 220(S) (θ,φ) and the width d of the listener's head 210. For example, suppose that the actual audio source 220(S) is at the point (θ,φ) and a distance r from the listener 210; i.e., in Cartesian coordinates (r sin θ cos φ, r sin θ sin φ, r cos θ). The left and right ears 212(L,R) of the listener 210 are at the points in Cartesian coordinates (0, ±d/2,0), respectively. Then any point on the lines through each ear 212(L,R) has the Cartesian coordinates $$(r \sin\theta \cos\varphi t, r \sin\theta \sin\varphi t \pm d/2(1-t), r \cos\theta t), \tag{3}$$

where t is any real number. The loudspeaker position manager 150 then finds the value oft at which the length of the vector described by the expression in (3) is equal to the radius of the sphere, denoted here by S. The equation for the unknown value oft is a quadratic equation with two possible solutions. The desired value oft for each ear, i.e., $t_L$ and $t_R$, is determined based on whether r is greater than or less than S. In some implementations, the corresponding positions on the sphere 220(L,R) may be found as follows:

$$\cos\theta_{L,R} = \frac{rt_{L,R}}{S}\cos\theta, \tag{4}$$

$$\cos\phi_{L,R} = \frac{rt_{L,R}}{S}\frac{\sin\theta}{\sin\theta_{L,R}}\cos\phi. \tag{5}$$

The above Eqs. (4) and (5) also apply to the actual audio source 230(S). Nevertheless, in some implementations, if the distance r from the listener 210 is large enough, then the points 230(L) and 230(R) may be considered close enough that a single loudspeaker at the point 230(A) may be used instead for both the left and right ears 212(L) and 212(R).

Binaural rendering of the sound field $X_L(\theta_L,\theta_L,f)$ in the left ear 212(L) and the sound field $X_R(\theta_R,\varphi_R,f)$ in the right ear 212(R) is effected by performing a convolution operation on each of the sound fields with respective HRTFs $H_L$ or $H_R$ of each of the virtual loudspeakers according to whether they are left or right virtual loudspeakers. Note that a convolution operation over time is equivalent to a multiplication operation in frequency space. Accordingly, the sound fields in the left ear 212(L) L (i.e., the left sound field data 172) and right ear 212(R) R (i.e., the right sound field data 174) from the actual audio source 220(S) are as follows:

$$L(f) = \sum_{l=0}^{N}\sum_{m=-l}^{l} w_{l^2+l+m}(f)Y_{lm}(\theta_L, \phi_L)H_L(\theta_L, \phi_L, f), \tag{6}$$

$$R(f) = \sum_{l=0}^{N}\sum_{m=-l}^{l} w_{l^2+l+m}(f)Y_{lm}(\theta_R, \phi_R)H_R(\theta_R, \phi_R, f). \tag{7}$$

The HRTFs $H_L$ and $H_R$ are shown here to be dependent on angle. In some arrangements, these HRTFs may be computed from data at a finite set of positions on the sphere by an interpolation operation. In other arrangements, these HRTFs $H_L$ and $H_R$ as shown in Eqs. (6) and (7) are simply left and right HRTFs from a theoretical loudspeaker at the position 220(A).

In some arrangements, the filter manager 160 produces a filter F for each loudspeaker 220(L) and 220(R). For example, as discussed above, when the actual audio source 220(S) is very close to the left ear 212(L), the filter operator may boost the amplitude of the sound corresponding to bass, i.e., low, frequencies for the sound field $X_L$. In general, the effect of the filter F is to multiply the sound fields $X_L$, $X_R$ in frequency space prior to the application of the respective HRTFs.

In some arrangements, the sound acquisition manager 130 may also consider sound fields in the time domain, prior to transformation to the frequency domain, at retarded times. For example, if the distance between the actual audio source 220(S) and each of the left and right ears, respectively, is $r_{L,R}$, then the retarded sound fields in the time domain $x_{L,R}$ may be given by $$x_{L,R}\left(t - \frac{r_{L,R}}{c}\right), \tag{8}$$

where c is the speed of a sound wave. The sound acquisition manager 130 may then transform these fields to frequency space before rendering. In further implementations, sound acquisition manager 130 may attenuate each such sound field to produce $$\frac{1}{r_{L,R}}x_{L,R}\left(t - \frac{r_{L,R}}{c}\right). \tag{9}$$

Figure 3:
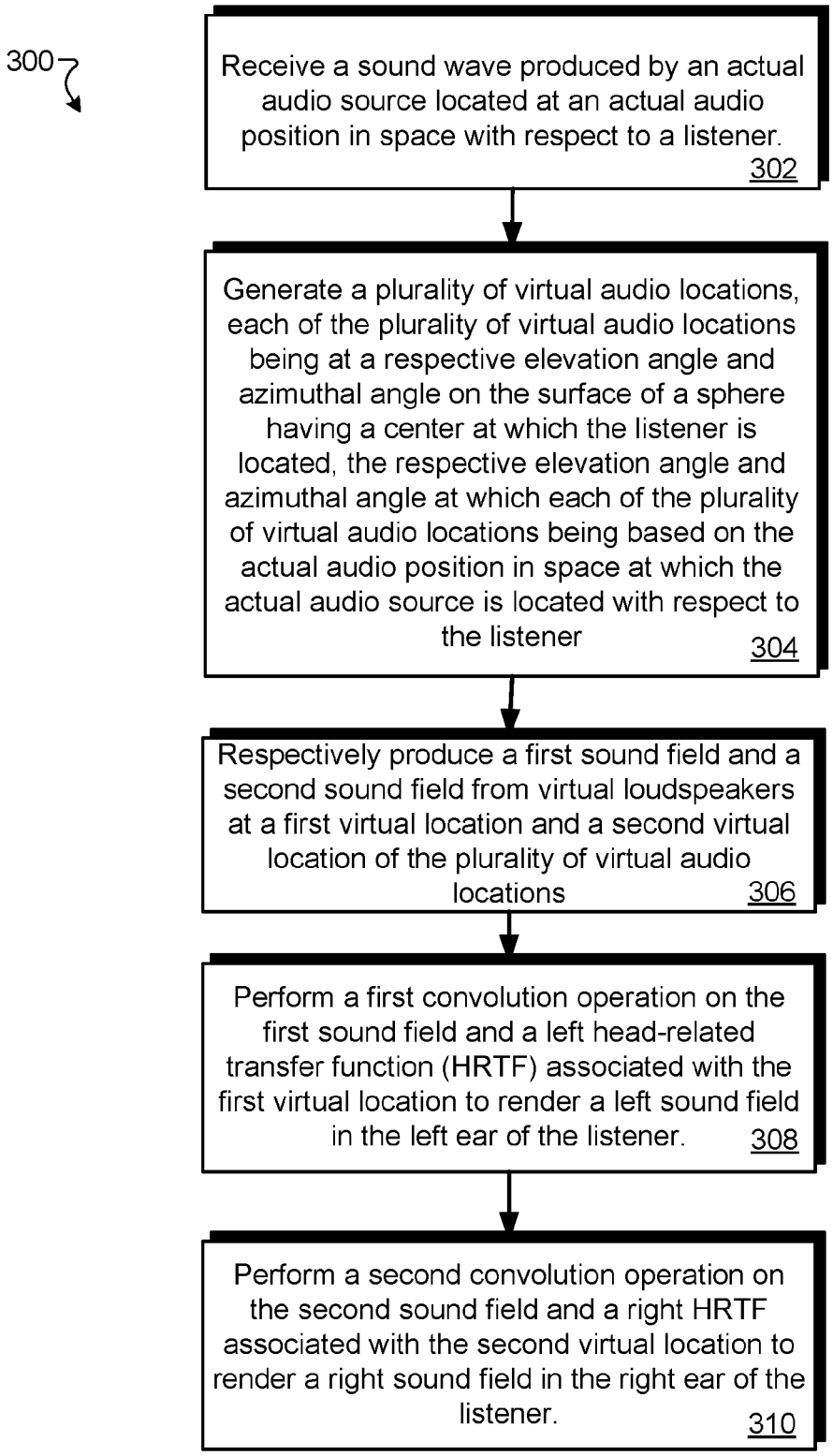
FIG. 3 is a flow chart that illustrates an example method of performing the improved techniques within the electronic environment shown in FIG. 1.

FIG. 3 is a flow chart that illustrates an example method 300 of performing binaural rendering of sound. The method 300 may be performed by software constructs described in connection with FIG. 1, which reside in memory 126 of the point cloud compression computer 120 and are run by the set of processing units 124.

At 302, controlling circuitry of an audio rendering computer configured to render sound fields in a left ear and a right ear of a listener receives a sound wave produced by an actual audio source located at an actual audio position in space with respect to a listener.

At 304, the controlling circuitry generates a plurality of virtual audio locations, each of the plurality of virtual audio locations being at a respective elevation angle and azimuthal angle on the surface of a sphere having a center at which the listener is located. The respective elevation angle and azimuthal angle at which each of the plurality of virtual audio locations is based on the actual audio position in space at which the actual audio source is located with respect to the listener.

At 306, the controlling circuitry respectively produces a first sound field and a second sound field from virtual loudspeakers at a first virtual location and a second virtual location of the plurality of virtual audio locations.

At 308, the controlling circuitry performs a first convolution operation on the first sound field and a left head-related transfer function (HRTF) associated with the first virtual location to render a left sound field in the left ear of the listener.

At 310, the controlling circuitry performs a second convolution operation on the second sound field and a right HRTF associated with the second virtual location to render a right sound field in the right ear of the listener.

Figure 4:
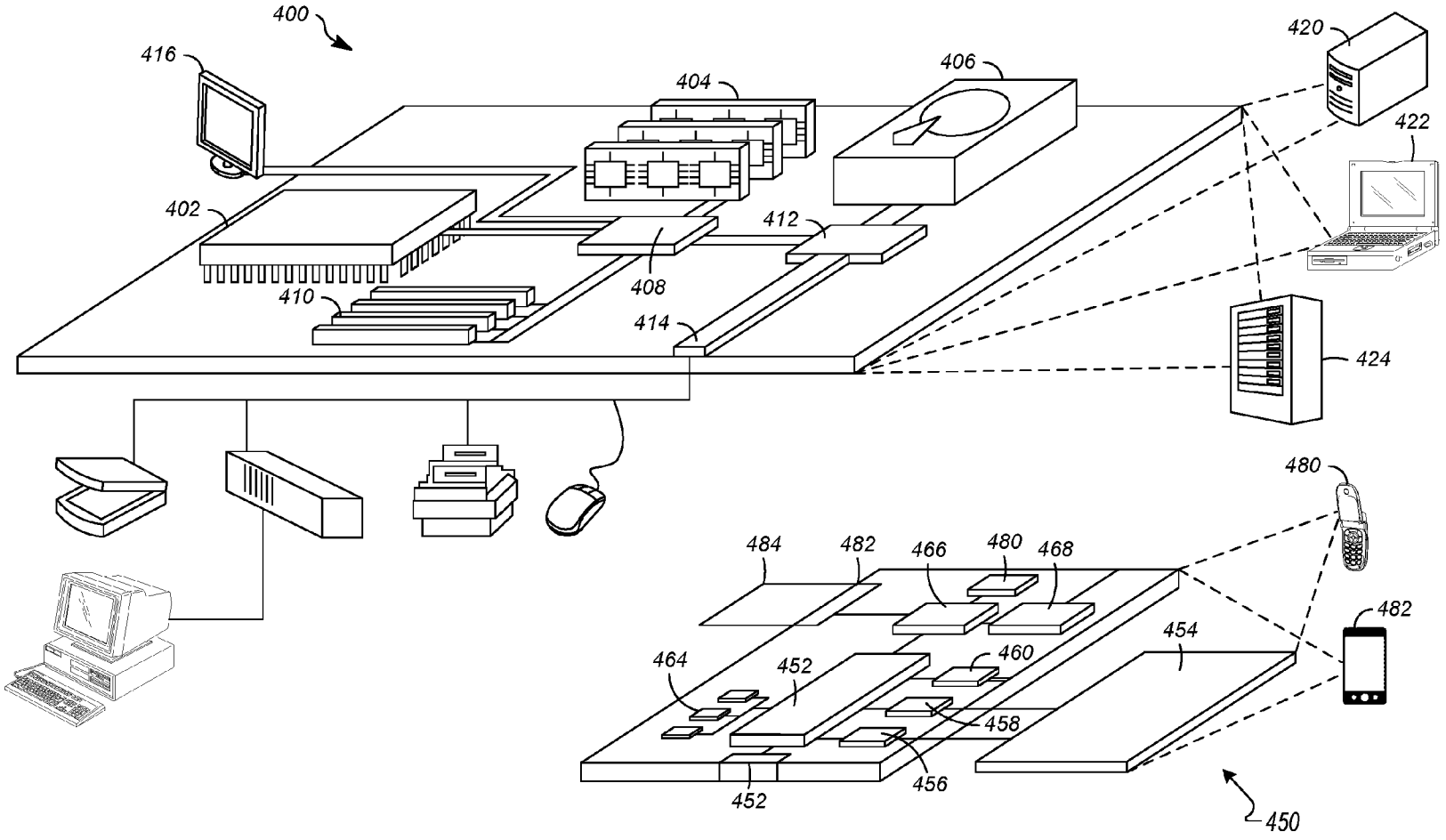
FIG. 4 illustrates an example of a computer device and a mobile computer device that can be used with circuits described here.

FIG. 4 illustrates an example of a generic computer device 400 and a generic mobile computer device 450, which may be used with the techniques described here.

As shown in FIG. 4, computing device 400 is intended to represent various forms of digital computers, such as laptops, desktops, workstations, personal digital assistants, servers, blade servers, mainframes, and other appropriate computers. Computing device 450 is intended to represent various forms of mobile devices, such as personal digital assistants, cellular telephones, smart phones, and other similar computing devices. The components shown here, their connections and relationships, and their functions, are meant to be exemplary only, and are not meant to limit implementations of the inventions described and/or claimed in this document.

Computing device 400 includes a processor 402, memory 404, a storage device 406, a high-speed interface 408 connecting to memory 404 and high-speed expansion ports 410, and a low speed interface 412 connecting to low speed bus 414 and storage device 406. Each of the components 402, 404, 406, 408, 410, and 412, are interconnected using various busses, and may be mounted on a common motherboard or in other manners as appropriate. The processor 402 can process instructions for execution within the computing device 400, including instructions stored in the memory 404 or on the storage device 406 to display graphical information for a GUI on an external input/output device, such as display 416 coupled to high speed interface 408. In other implementations, multiple processors and/or multiple buses may be used, as appropriate, along with multiple memories and types of memory. Also, multiple computing devices 400 may be connected, with each device providing portions of the necessary operations (e.g., as a server bank, a group of blade servers, or a multi-processor system).

The memory 404 stores information within the computing device 400. In one implementation, the memory 404 is a volatile memory unit or units. In another implementation, the memory 404 is a non-volatile memory unit or units. The memory 404 may also be another form of computer-readable medium, such as a magnetic or optical disk.

The storage device 406 is capable of providing mass storage for the computing device 400. In one implementation, the storage device 406 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 404, the storage device 406, or memory on processor 402.

The high speed controller 408 manages bandwidth-intensive operations for the computing device 400, while the low speed controller 412 manages lower bandwidth-intensive operations. Such allocation of functions is exemplary only. In one implementation, the high-speed controller 408 is coupled to memory 404, display 416 (e.g., through a graphics processor or accelerator), and to high-speed expansion ports 410, which may accept various expansion cards (not shown). In the implementation, low-speed controller 412 is coupled to storage device 406 and low-speed expansion port 414. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 400 may be implemented in a number of different forms, as shown in the figure. For example, it may be implemented as a standard server 420, or multiple times in a group of such servers. It may also be implemented as part of a rack server system 424. In addition, it may be implemented in a personal computer such as a laptop computer 422. Alternatively, components from computing device 400 may be combined with other components in a mobile device (not shown), such as device 450. Each of such devices may contain one or more of computing device 400, 450, and an entire system may be made up of multiple computing devices 400, 450 communicating with each other.

Computing device 450 includes a processor 452, memory 464, an input/output device such as a display 454, a communication interface 466, and a transceiver 468, among other components. The device 450 may also be provided with a storage device, such as a microdrive or other device, to provide additional storage. Each of the components 450, 452, 464, 454, 466, and 468, are interconnected using various buses, and several of the components may be mounted on a common motherboard or in other manners as appropriate.

The processor 452 can execute instructions within the computing device 450, including instructions stored in the memory 464. The processor may be implemented as a chipset of chips that include separate and multiple analog and digital processors. The processor may provide, for example, for coordination of the other components of the device 450, such as control of user interfaces, applications run by device 450, and wireless communication by device 450.

Processor 452 may communicate with a user through control interface 458 and display interface 456 coupled to a display 454. The display 454 may be, for example, a TFT LCD (Thin-Film-Transistor Liquid Crystal Display) or an OLED (Organic Light Emitting Diode) display, or other appropriate display technology. The display interface 456 may comprise appropriate circuitry for driving the display 454 to present graphical and other information to a user. The control interface 458 may receive commands from a user and convert them for submission to the processor 452. In addition, an external interface 462 may be provided in communication with processor 452, so as to enable near area communication of device 450 with other devices. External interface 462 may provide, for example, for wired communication in some implementations, or for wireless communication in other implementations, and multiple interfaces may also be used.

The memory 464 stores information within the computing device 450. The memory 464 can be implemented as one or more of a computer-readable medium or media, a volatile memory unit or units, or a non-volatile memory unit or units. Expansion memory 474 may also be provided and connected to device 450 through expansion interface 472, which may include, for example, a SIMM (Single In Line Memory Module) card interface. Such expansion memory 474 may provide extra storage space for device 450, or may also store applications or other information for device 450. Specifically, expansion memory 474 may include instructions to carry out or supplement the processes described above, and may include secure information also. Thus, for example, expansion memory 474 may be provided as a security module for device 450, and may be programmed with instructions that permit secure use of device 450. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 464, expansion memory 474, or memory on processor 452, that may be received, for example, over transceiver 468 or external interface 462.

Device 450 may communicate wirelessly through communication interface 466, which may include digital signal processing circuitry where necessary. Communication interface 466 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 468. In addition, short-range communication may occur, such as using a Bluetooth, WiFi, or other such transceiver (not shown). In addition, GPS (Global Positioning System) receiver module 470 may provide additional navigation- and location-related wireless data to device 450, which may be used as appropriate by applications running on device 450.

Device 450 may also communicate audibly using audio codec 460, which may receive spoken information from a user and convert it to usable digital information. Audio codec 460 may likewise generate audible sound for a user, such as through a speaker, e.g., in a handset of device 450. Such sound may include sound from voice telephone calls, may include recorded sound (e.g., voice messages, music files, etc.) and may also include sound generated by applications operating on device 450.

The computing device 450 may be implemented in a number of different forms, as shown in the figure. For example, it may be implemented as a cellular telephone 480. It may also be implemented as part of a smart phone 482, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system can include clients and servers. A client and server are generally remote from each other and typically interact through a communication network. The relationship of client and server arises by virtue of computer programs running on the respective computers and having a client-server relationship to each other.

A number of embodiments have been described. Nevertheless, it will be understood that various modifications may be made without departing from the spirit and scope of the specification.

It will also be understood that when an element is referred to as being on, connected to, electrically connected to, coupled to, or electrically coupled to another element, it may be directly on, connected or coupled to the other element, or one or more intervening elements may be present. In contrast, when an element is referred to as being directly on, directly connected to or directly coupled to another element, there are no intervening elements present. Although the terms directly on, directly connected to, or directly coupled to may not be used throughout the detailed description, elements that are shown as being directly on, directly connected or directly coupled can be referred to as such. The claims of the application may be amended to recite exemplary relationships described in the specification or shown in the figures.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components and/or features of the different implementations described.

In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

What is claimed is:

1. A method, comprising:

receiving, by processing circuitry of an audio rendering computer configured to render sound fields in a left ear and a right ear of a listener, a sound wave produced by an actual audio source located at an actual audio position in space with respect to a listener;

generating a plurality of virtual audio locations, each of the plurality of virtual audio locations being at a respective elevation angle and azimuthal angle on the surface of a sphere having a center at which the listener is located, the respective elevation angle and azimuthal angle at which each of the plurality of virtual audio locations being based on the actual audio position in space at which the actual audio source is located with respect to the listener;

respectively producing a first sound field and a second sound field from virtual loudspeakers at a first virtual location and a second virtual location of the plurality of virtual audio locations;

performing a first convolution operation on the first sound field and a left head-related transfer function (HRTF) associated with the first virtual location to render a left sound field in the left ear of the listener; and performing a second convolution operation on the second sound field and a right HRTF associated with the second virtual location to render a right sound field in the right ear of the listener.

2. The method as in claim 1, wherein generating the plurality of virtual audio locations includes:

locating a first point of intersection on the sphere of a line that includes the left ear of the listener and the actual source location to produce the first source location; and locating a second point of intersection on the sphere of a line that includes the right ear of the listener and the actual source location to produce the second source location.

3. The method as in claim 1, wherein respectively producing the first sound field and the second sound field from virtual loudspeakers at the first virtual location and the second virtual location includes:

generating a first bandpass filter having a first range of frequencies over which the first bandpass filter has values greater than a threshold value, the first range of frequencies being based on a distance between the actual source location and the left ear of the listener;

generating a second bandpass filter having a second range of frequencies over which the second bandpass filter has values greater than the threshold value, the second range of frequencies being based on a distance between the actual source location and the right ear of the listener; and multiplying a first base sound field by the first bandpass filter to produce the first sound field and multiplying a second base sound field by the second bandpass filter to produce the second sound field.

4. The method as in claim 3, wherein the actual audio position in space at which the actual audio source is located with respect to the listener is in the interior of the sphere and is closer to the left ear of the listener than the right ear of the listener, wherein each of the first range of frequencies and the second range of frequencies corresponds to a bass sound range, wherein the method further comprises increasing an amplitude of the first sound field over the first range of frequencies and not increasing the amplitude of the second sound field over the second range of frequencies.

5. The method as in claim 1, wherein performing the first convolution operation includes evaluating the first sound field at a time equal to a difference between the present time and a first time shift based on a distance between the actual audio position in space with respect to the listener and the left ear of the listener, and wherein performing the second convolution operation includes evaluating the second sound field at a time equal to a difference between the present time and a second time shift based on a distance between the actual audio position in space with respect to the listener and the right ear of the listener.

6. The method as in claim 5, wherein performing the first convolution operation further includes attenuating the first sound field by a factor based on the distance between the actual audio position in space with respect to the listener and the left ear of the listener, and wherein performing the second convolution operation further includes attenuating the second sound field by a factor based on the distance between the actual audio position in space with respect to the listener and the right ear of the listener.

7. A computer program product comprising a nontransitory storage medium, the computer program product including code that, when executed by processing circuitry of an audio rendering computer configured to render sound fields in a left ear and a right ear of a listener, causes the processing circuitry to perform a method, the method comprising:

receiving a sound wave produced by an actual audio source located at an actual audio position in space with respect to a listener;

generating a plurality of virtual audio locations, each of the plurality of virtual audio locations being at a respective elevation angle and azimuthal angle on the surface of a sphere having a center at which the listener is located, the respective elevation angle and azimuthal angle at which each of the plurality of virtual audio locations being based on the actual audio position in space at which the actual audio source is located with respect to the listener;

respectively producing a first sound field and a second sound field from virtual loudspeakers at a first virtual location and a second virtual location of the plurality of virtual audio locations;

performing a first convolution operation on the first sound field and a left head-related transfer function (HRTF) associated with the first virtual location to render a left sound field in the left ear of the listener; and performing a second convolution operation on the second sound field and a right HRTF associated with the second virtual location to render a right sound field in the right ear of the listener.

8. The computer program product as in claim 7, wherein generating the plurality of virtual audio locations includes:

locating a first point of intersection on the sphere of a line that includes the left ear of the listener and the actual source location to produce the first source location; and locating a second point of intersection on the sphere of a line that includes the right ear of the listener and the actual source location to produce the second source location.

9. The computer program product as in claim 7, wherein respectively producing the first sound field and the second sound field from virtual loudspeakers at the first virtual location and the second virtual location includes:

generating a first bandpass filter having a first range of frequencies over which the first bandpass filter has values greater than a threshold value, the first range of frequencies being based on a distance between the actual source location and the left ear of the listener;

generating a second bandpass filter having a second range of frequencies over which the second bandpass filter has values greater than the threshold value, the second range of frequencies being based on a distance between the actual source location and the right ear of the listener; and multiplying a first base sound field by the first bandpass filter to produce the first sound field and multiplying a second base sound field by the second bandpass filter to produce the second sound field.

10. The computer program product as in claim 9, wherein the actual audio position in space at which the actual audio source is located with respect to the listener is in the interior of the sphere and is closer to the left ear of the listener than the right ear of the listener, wherein each of the first range of frequencies and the second range of frequencies corresponds to a bass sound range, wherein the method further comprises increasing an amplitude of the first sound field over the first range of frequencies and not increasing the amplitude of the second sound field over the second range of frequencies.

11. The computer program product as in claim 7, wherein performing the first convolution operation includes evaluating the first sound field at a time equal to a difference between the present time and a first time shift based on a distance between the actual audio position in space with respect to the listener and the left ear of the listener, and wherein performing the second convolution operation includes evaluating the second sound field at a time equal to a difference between the present time and a second time shift based on a distance between the actual audio position in space with respect to the listener and the right ear of the listener.

12. The computer program product as in claim 11, wherein performing the first convolution operation further includes attenuating the first sound field by a factor based on the distance between the actual audio position in space with respect to the listener and the left ear of the listener, and wherein performing the second convolution operation further includes attenuating the second sound field by a factor based on the distance between the actual audio position in space with respect to the listener and the right ear of the listener.

13. An electronic apparatus configured to render sound fields in a left ear and a right ear of a listener, the electronic apparatus comprising:

memory; and controlling circuitry coupled to the memory, the controlling circuitry being configured to:

receive a sound wave produced by an actual audio source located at an actual audio position in space with respect to a listener;

generate a plurality of virtual audio locations, each of the plurality of virtual audio locations being at a respective elevation angle and azimuthal angle on the surface of a sphere having a center at which the listener is located, the respective elevation angle and azimuthal angle at which each of the plurality of virtual audio locations being based on the actual audio position in space at which the actual audio source is located with respect to the listener;

respectively produce a first sound field and a second sound field from virtual loudspeakers at a first virtual location and a second virtual location of the plurality of virtual audio locations;

perform a first convolution operation on the first sound field and a left head-related transfer function (HRTF) associated with the first virtual location to render a left sound field in the left ear of the listener; and perform a second convolution operation on the second sound field and a right HRTF associated with the second virtual location to render a right sound field in the right ear of the listener.

14. The electronic apparatus as in claim 13, wherein the controlling circuitry configured to generate the plurality of virtual audio locations is further configured to:

locate a first point of intersection on the sphere of a line that includes the left ear of the listener and the actual source location to produce the first source location; and locate a second point of intersection on the sphere of a line that includes the right ear of the listener and the actual source location to produce the second source location.

15. The electronic apparatus as in claim 13, wherein the controlling circuitry configured to respectively produce the first sound field and the second sound field from virtual loudspeakers at the first virtual location and the second virtual location is further configured to:

generate a first bandpass filter having a first range of frequencies over which the first bandpass filter has values greater than a threshold value, the first range of frequencies being based on a distance between the actual source location and the left ear of the listener;

generate a second bandpass filter having a second range of frequencies over which the second bandpass filter has values greater than the threshold value, the second range of frequencies being based on a distance between the actual source location and the right ear of the listener; and multiply a first base sound field by the first bandpass filter to produce the first sound field and multiplying a second base sound field by the second bandpass filter to produce the second sound field.

16. The electronic apparatus as in claim 15, wherein the actual audio position in space at which the actual audio source is located with respect to the listener is in the interior of the sphere and is closer to the left ear of the listener than the right ear of the listener, wherein each of the first range of frequencies and the second range of frequencies corresponds to a bass sound range, wherein the controlling circuitry is further configured to increase an amplitude of the first sound field over the first range of frequencies and not increasing the amplitude of the second sound field over the second range of frequencies.

17. The electronic apparatus as in claim 13, wherein the controlling circuitry configured to perform the first convolution operation is further configured to evaluate the first sound field at a time equal to a difference between the present time and a first time shift based on a distance between the actual audio position in space with respect to the listener and the left ear of the listener, and wherein the controlling circuitry configured to perform the second convolution operation is further configured to evaluate the second sound field at a time equal to a difference between the present time and a second time shift based on a distance between the actual audio position in space with respect to the listener and the right ear of the listener.

18. The electronic apparatus as in claim 17, wherein the controlling circuitry configured to perform the first convolution operation is further configured to attenuate the first sound field by a factor based on the distance between the actual audio position in space with respect to the listener and the left ear of the listener, and wherein the controlling circuitry configured to perform the second convolution operation is further configured to attenuate the second sound field by a factor based on the distance between the actual audio position in space with respect to the listener and the right ear of the listener.

* * * * *